United States Patent [19]

Zwieg et al.

[11] Patent Number: 4,746,319

[45] Date of Patent: May 24, 1988

[54] COUNT MECHANISM FOR COIN DISPENSING MACHINE

[75] Inventors: Robert L. Zwieg; Charles T. Bergman, both of Watertown, Wis.

[73] Assignee: Brandt, Inc., Watertown, Wis.

[21] Appl. No.: 253,914

[22] Filed: Apr. 14, 1981

[51] Int. Cl.[4] ..... G07D 9/04

[52] U.S. Cl. ..... 453/32; 377/7; 453/35

[58] Field of Search ..... 133/1 A, 8 R, 8 A; 235/92 CN, 98 C; 453/32, 35; 377/7

[56] References Cited

U.S. PATENT DOCUMENTS 2,973,768 3/1961 Buchholz et al. .

3,246,658 4/1966 Buchholz et al. .

*Primary Examiner*—F. J. Bartuska

*Attorney, Agent, or Firm*—Quarles & Brady

[57] ABSTRACT

A count mechanism for a dispensing machine which delivers coins in a single file along a track has a star wheel in the path of travel of the coins. The star wheel is indexed one point for each coin which passes it. The star wheel can be locked against rotation by a latch which engages a point on the wheel and which is held disengaged by a first solenoid. A second solenoid assists in disengaging the latch from the star wheel. A spring biased pawl rides the periphery of the star wheel between points to prevent free rotation. The star wheel is provided with spaced reflective areas on its top surface and a pair of spaced optical sensors detect the presence and absence of reflective surfaces as the reflective areas pass beneath the sensors. The optical sensors generate a pair of out-of-phase pulses which are employed to count the coins. A mechanism is also provided to test for dirty conditions of the star wheel or optical sensors.

14 Claims, 3 Drawing Sheets

FIG.1
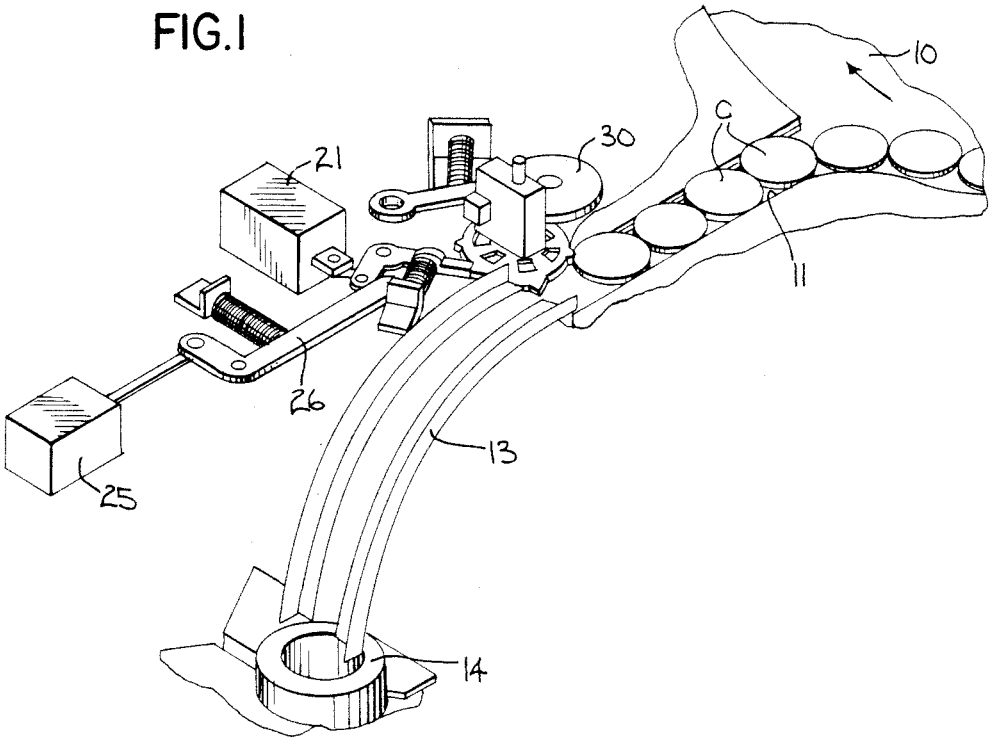
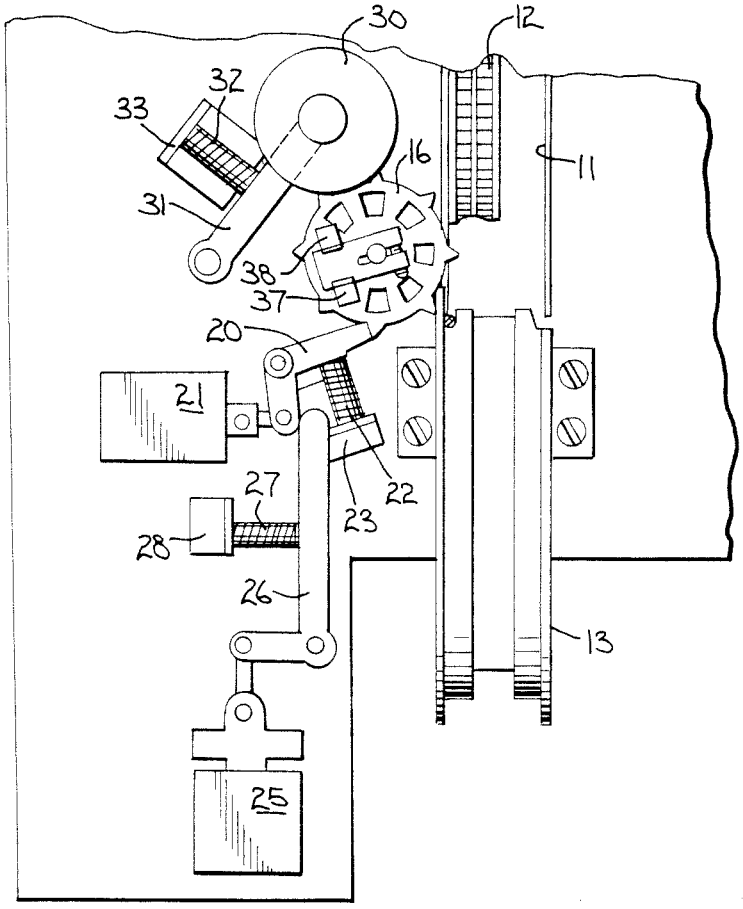
FIG.2

COUNT MECHANISM FOR COIN DISPENSING MACHINE

BACKGROUND OF THE INVENTION

This invention relates to coin dispensing equipment used in packaging or wrapping coins, and particularly to a count mechanism for counting and controlling the feeding of coins from a coin dispenser.

Coin dispensing equipment is employed to form coins of a single denomination into a single file and to feed the coins seriatum to a point where they may be packaged in preformed paper rolls or bags, or to deliver them to automatic wrapping equipment which forms the coins into stacks of a predetermined quantity and thereafter automatically wraps the stack in a web of paper or other sheet material. An example of coin packaging machines is found in U.S. Pat. No. 2,973,768, issued Mar. 7, 1961 to Buchholz et al. An example of the automatic coin wrapping machine is found in U.S. Pat. No. 4,089,151, issued May 16, 1978, to Bergman et al.

Whether the dispenser is incorporated into a coin packager or into an automatic wrapper, it is necessary to be able to count the flow of coins from the dispenser and to have the capability of halting the flow once a predetermined count has been reached. The predetermined count may be either that which is necessary to form a single roll of coins or that which is necessary to fill a standard bag with a particular denomination of coin.

The coin dispenser mechanism typically includes a horizontal rotating disc forming the bottom of a hopper in which coins are deposited. As the disc rotates, coins on its surface are formed into a single file at its periphery by centrifugal force. The single file of coins is fed to a coin track where the coins are engaged by a driven roller or belt and forced past a multipointed wheel, known as a star wheel, which is indexed a finite amount by the passage of each coin. The indexing of the star wheel is typically employed to count the coins. The counting may be accomplished through a mechanical mechanism responsive to the rotation of the shaft which mounts the star wheel, such as illustrated in the aforesaid U.S. Pat. No. 2,973,768, or it may be accomplished by electrical pulses produced by rotation of the shaft, as shown in U.S. Pat. No. 3,246,658, issued Apr. 19, 1966, to Buchholz et al. In either of these two cases, whether the count is produced mechanically or electrically, the count is employed to trigger a complex mechanical linkage which halts the rotation of the shaft mounting the star wheel when a predetermined count has been achieved. Another example of the use of the rotation of the star wheel shaft to produce electrical pulses used for counting is found in U.S. Pat. No. 4,216,788, issued Aug. 12, 1980 to Watanabe.

The count mechanism of this invention produces electrical pulses to accurately register the counting of coins and provides a simplified mechanical arrangement to physically halt the rotation of the star wheel upon a signal that the proper count has been achieved. The count mechanism produces the electrical pulses by the use of optical sensors which use a beam of light reflected off of the surface of the rotating star wheel.

SUMMARY OF THE INVENTION

In accordance with the invention, I provide a count mechanism for a coin dispensing machine including a multipointed wheel whose points are disposed in the path of travel of coins, a detent tending to retard rotation of the wheel, and a latch which is controllably engageable with a point on the wheel to prevent rotation of the wheel.

The invention may further reside in such a count mechanism in which a surface of the wheel is provided with spaced reflective areas and in which optical sensor means responds to the passage of the reflective areas to produce electrical pulses employed for counting the passage of coins, together with control means responsive to the sensor means to control engagement of the latch.

The invention may also reside in apparatus and method for testing to detect when the sensor means is dirty and incapable of accurately responding to the indexing of the wheel.

It is a principal object of the invention to provide a count mechanism for a coin dispenser which will provide an accurate count of coins passing a rotating star wheel.

It is another object of the invention to provide such a count mechanism which can be positively halted and prevented from being indexed to stop the flow of coins past it.

It is still another object of the invention to provide such a count mechanism which has a diagnostic system for determining when the counting devices require cleaning or other maintenance.

The foregoing and other objects of the invention will appear from the detailed description which follows. In the detailed description reference is made to the accompanying drawings which illustrate a preferred embodiment of the invention.

BRIEF DESCRIPTION OF THE DRAWINGS

FIG. 1 is a view in perspective of a count mechanism in accordance with the present invention;

FIG. 2 is a top plan view of the count mechanism;

DETAILED DESCRIPTION OF THE PREFERRED EMBODIMENT

Figure 3:
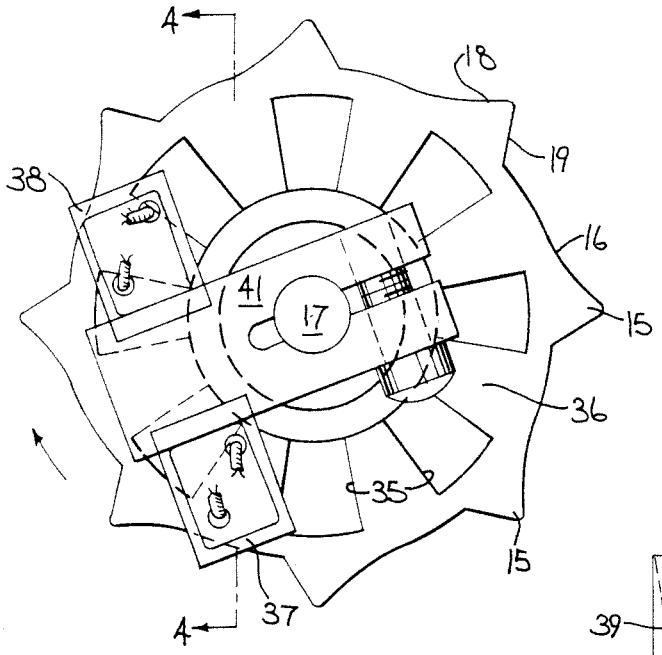
FIG. 3 is a view of the star wheel and optical sensors shown to an enlarged scale.

The count mechanism is illustrated as being part of a coin dispenser section of a coin wrapping machine. Coins are deposited upon a horizontal, rotating disc 10 which forms the coins C into a single file and delivers them to the entrance of a track 11. The coins in the track 11 are forced along the track by a driven conveyer belt 12 to a discharge chute 13 which directs the coins to the open top of a stacking tube 14. The wrapping machine illustrated is similar to that disclosed and described in the application of Charles T. Bergman and Robert L. Zwieg for Coin Wrapper Machine filed contemporaneous herewith.

As the coins are forced along the track 11 by the conveyer belt 12, they will encounter the teeth or points 15 of a star wheel 16. The star wheel 16 is journaled on a vertical shaft 17 mounted adjacent an edge of the track 11. As illustrated in the drawings, the trailing side 18 of each point 15 is provided with a gently curved surface. This is the surface which is engaged by a coin being forced past the star wheel 16. The leading edge of each point 15 has a flat surface 19 which forms an obtuse angle at its junction with the periphery of the star wheel 16. The flat surface 19 functions as an abutment and is engageable by a latch 20 in the form of a bell crank lever having its free end positioned where it can abut the front edge 19 of a point 15 of the star wheel 16. The latch lever 20 is pivoted intermediate its ends on a vertical axis and has its opposite end connected to the actuator of a latch solenoid 21. A compression spring 22 is biased between the free end of the latch lever 20 and a bracket 23 to urge the latch lever 20 into a position in which it engages a tooth on the star wheel 16. When the latch lever 20 is in engagement with the star wheel 16, the star wheel 16 cannot rotate on the shaft 17 and coins cannot pass the star wheel.

To assist in releasing the latch lever 20 from engagement with the star wheel 16, a power release solenoid 25 is connected to one end of a release bell crank lever 26 which has its free end bearing against the actuator connected end of the latch lever 20. Whenever the release solenoid 25 is energized, the release lever 26 is pivoted about its vertical axis and moves the actuator of the latch solenoid 21 inwardly to pivot the latch lever 20 out of engagement with the star wheel 16. The latch lever 20 is held out of engagement against the urgings of the spring 22 by energizing the latch solenoid 21. A compression spring 27 is biased between the release lever 26 and a bracket 28 and urges the free end of the release lever away from the actuator connected end of the latch lever 20.

A detent pawl in the form of a large roller 30 is mounted on the free end of an arm 31 which is pivoted about a vertical axis. The pawl 30 is adapted to ride the periphery of the star wheel 16 and to rest in the space between adjacent points 15 on the star wheel. The pawl 30 is urged to this position by a compression spring 32 biased between the arm 31 and a bracket 33. The pawl 30 functions to prevent free rotation of the star wheel 16 so that the star wheel 16 is indexed only by the passage of a coin.

Figure 4:
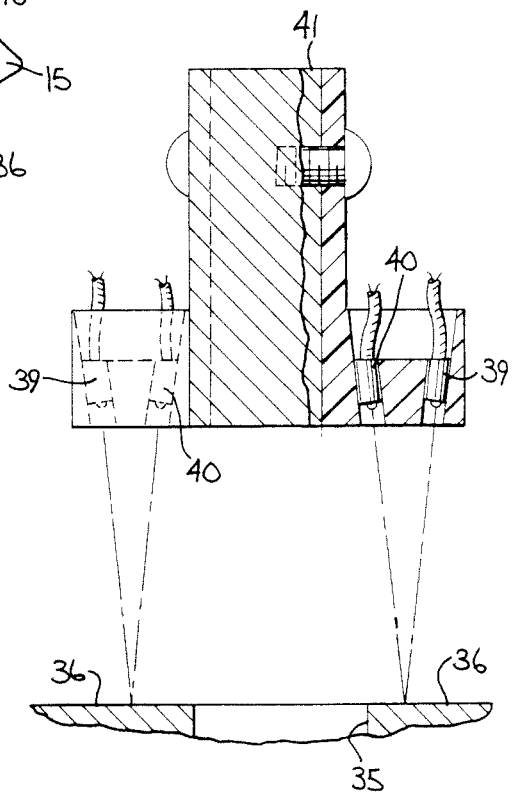
FIG. 4 is a view in vertical section taken in the plane of the line 4—4 of FIG. 3 and illustrating the optical sensors.

The star wheel 16 is formed with a plurality of cutouts or openings 35 equal in number to the points 15 on the wheel 16. The circumferential width of the openings 35 is equal to the width of the spokes between the openings 35. The upper surface 36 of the wheel 16 is plated or otherwise treated to provide a highly reflective surface. The reflective surface 36 is employed in connection with a pair of optical sensors 37 and 38 to provide electrical pulses which are used to register the counts of coins passing the star wheel 16. Each of the optical sensors includes a source of light in the form of a light emitting diode 39 and a light sensitive receiver such as a photoelectric cell 40. The sensors 37 and 38 are mounted on opposite sides of a mounting block 41 which in turn is secured to the upper projecting end of the shaft 17. As shown in FIG. 4, the light from each light emitting diode 39 is directed against the top surface 36 of the wheel 16 so that when the reflective surface 36 is present, the light beam will reflect upwardly to the photoelectric cell 40. Obviously, when an opening 35 is at the point of focus there is no reflection of the light beam.

Figure 5:
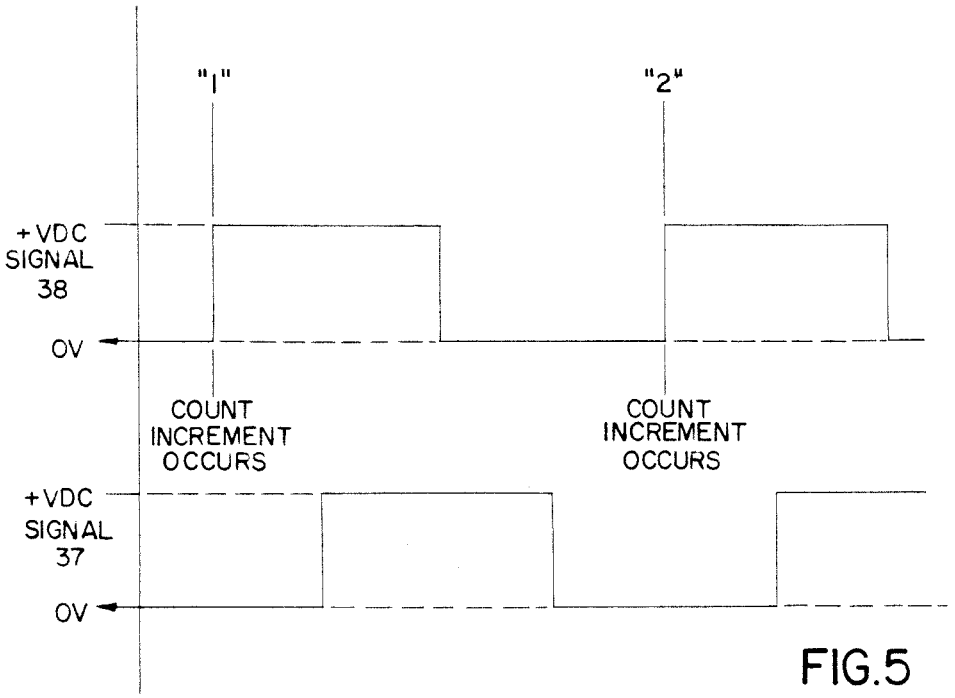
FIG. 5 is a schematic illustration of the counting pulses produced by the two optical sensors.

The two sensors 37 and 38 are so arranged relative to the spacing between the openings 35 and with respect to each other that the signals which they produce are out of phase from each other. FIG. 5 illustrates the ideal signals from the two sensors beginning with the star wheel at rest. When the star wheel 16 is at rest, reflective surfaces of the star wheel will be at the focus point of both sensors 37 and 38. A logic low signal is produced when reflected light is received by the photocells 40, and a logic high is produced when no light is reflected to a receiver 40. It can be seen from FIG. 5 that the electrical pulses are 90° out of phase. As shown in FIG. 3, the out of phase signals results from the spacing between the sensors 37 and 38 in relation to the spacing between the opening 35. That is, the focus of the first sensor 37 in FIG. 3 is adjacent the leading edge of a reflective spoke area between adjacent openings 35 while the focus of the second sensor 38 is adjacent the trailing edge of a reflective area. Since the star wheel 16 will index one point for each coin, during each indexing the first sensor 37 will pass over most of one reflective area, an entire opening, and a small portion of another reflective area. During the same indexing, the second sensor 38 will pass over a small portion of one reflective area, an entire opening 35 and most of another reflective area. It will be appreciated that the sensors are spaced apart a distance which is not a whole multiple of the space between adjacent openings. The combination of the two signals are employed to provide an accurate count of coins.

Figure 6:
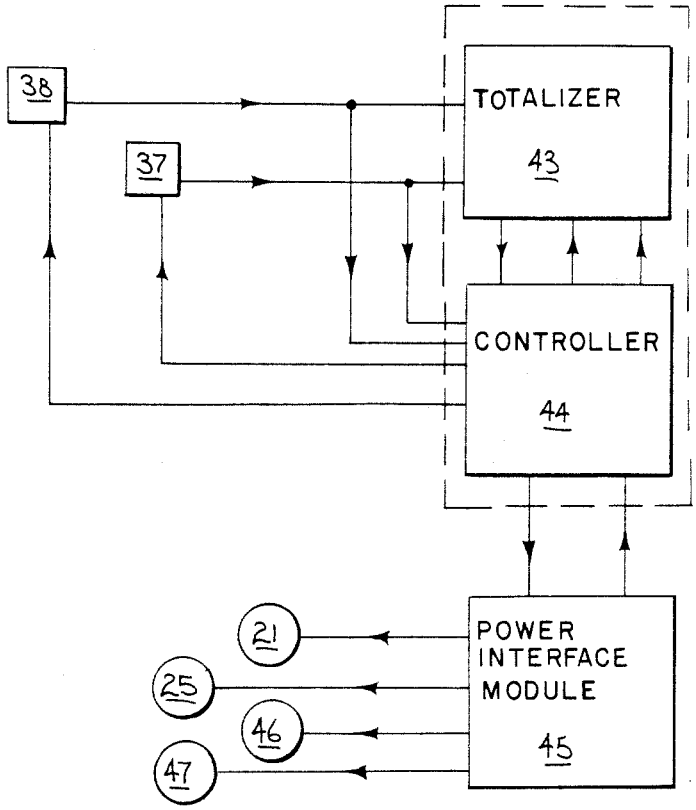
FIG. 6 is a schematic diagram of the control circuitry involving the count mechanism.

Referring to FIG. 6, the two signals from the sensors 37 and 38 are fed to an electronic totalizer 43. The totalizer 43 is of known construction and may take the form, for example, of the Series 3500 bi-directional totalizer manufactured by Durant Digital Instruments, Watertown, Wis. The totalizer 43 is operable in a known manner to receive the two out of phase signals from the sensors 37 and 38 and to count up when the signal from the second sensor 38 goes high when the first sensor 37 is low and to count down when the signal from the second sensor 38 goes low when the first sensor 37 is also low. The ability to count down is necessary to guard against an incorrect count if the coin should happen to only partially rotate the star wheel and the star wheel then moves backward under the urgings of the pawl 30. In that case the coin has not passed the star wheel and ought not to be counted. In a known manner, when a predetermined count has been accumulated a signal is fed to a controller 44 which is connected to a power interface module 45 which controls the operation of the latch solenoid 21, the release solenoid 25, and other solenoids and motors of the machine such as a motor 46 for driving the rotating disc 10 and the conveyer belt 12.

Because of the environment in which the coin dispenser is operated there is the likelihood that dirt will accumulate in front of either the light emitting diode 39 or the photoelectric cell 40 of the sensor. It is also possible that dirt will accumulate on the upper reflective surfaces 36 of the star wheel 16. If it does, the optical sensors may not go to a logic low voltage and there would be improper signals provided to the totalizer 43 such that coins would be missed in the count. The actual output of the photocells 40 is analog rather than digital so that as reflected light is reduced the output signal will tend to rise above logic low even if a reflective surface is present. Provision is made to test the optical sensors during static conditions and dynamic conditions to insure that they are operating properly and do not require cleaning or other maintenance.

As indicated in FIG. 5, when the star wheel 16 is at rest both signals from the two sensors 37 and 38 should be at a logic low voltage. The circuitry for the totalizer 43 and for the sensors is typically 12 volt level logic. The components used have a guaranteed high and low voltage range. For example, the totalizer may guarantee that any signal between zero volts and 3.6 volts will be recorded as a logic low while any signal from 8.4 volts to 12 volts will be recorded as a logic high. As reflection is diminished, the output of the photo cells will rise above the minimum of about 1 volt towards the upper level of the guaranteed low voltage. When dirt accumulates to the point of rendering the count mechanism functionally inoperative, the low voltage signal from the photo cells 40 will be above the guaranteed low of 3.6 volts. The control circuitry in the controller 44 uses a different voltage level, such as a 5 volt level logic. That voltage level also has guaranteed highs and lows. For example, the guaranteed high of the 5 volt level logic will be typically 3.5 volts whereas the guaranteed low would be 1.5 volts.

Figure 7:
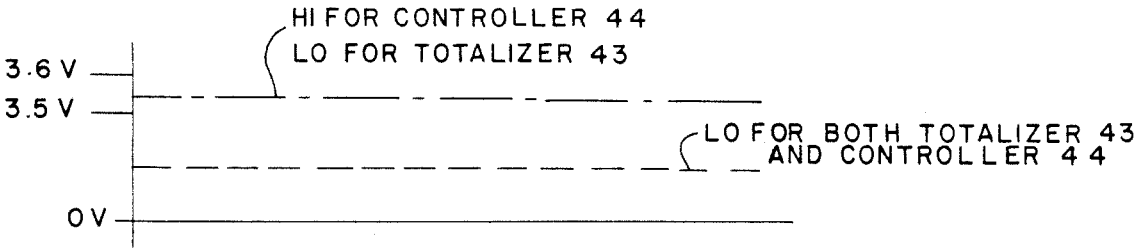
FIG. 7 is a schematic view illustrating the operation of the system for checking the operability of the sensors.

To determine whether the sensors are operating properly in a static condition for the star wheel, the output of the sensors is fed to the controller 44 as well as to the totalizer 43, as shown in FIG. 6. If dirt is accumulating on the sensors or the star wheel thereby reducing the amount of reflected light which reaches the photoelectric cells, the low voltage output will creep upwardly towards the 3.6 volt guaranteed low for the 12 volt logic system of the totalizer. However, that will be recognized by the 5 volt level logic of the controller 44 as a logic high signal. Thus, even though the totalizer reads a logic low the control system will read a logic high. That condition is used to signal the operator by lighting a warning light 47 that maintenance is required on the machine, or it can be used to have the controller 44 prevent energization of the release solenoid 25 and therefore prevent the rotation of the star wheel. When the sensors are functioning properly, both the totalizer 43 and controller 44 will read a logic low. The operation of the static condition test of the count mechanism is graphically illustrated in FIG. 7.

During dynamic operating condition, the length of time that a high signal is received from the two sensors 37 and 38 is also monitered by the controller 44. If either signal is high for too long a period in relation to the normal throughput speed of coins, it indicates that dirt is preventing proper low signals or that something is wrong with the rotation of the star wheel. A signal to the operator that maintenance is required is also given by lighting the warning light 47 and by deenergizing the latch solenoid 21 and the disc motor 46 to stop the star wheel 16 and halt the flow of coins.

In the preferred embodiment the absence of a reflective surface is provided by openings 35 in the star wheel 16. This has the advantage of reducing the mass of the star wheel thereby helping to insure that it will be stopped at the correct point. However, the nonreflective portions could also be provided by a darkened matte surface in the areas where the openings are provided.

We claim:

1. A count mechanism for a coin dispenser which moves coins single file along a track, said mechanism comprising:

a rotatable wheel having a plurality of equally spaced points about its periphery which lie in the path of travel of coins on said track and which is indexed one point by the passage of each coin;

a detent biased against the periphery of the wheel and tending to settle between successive points to retard rotation of the wheel; and a latch engagable with anyone of the points of said wheel to prevent rotation of said wheel and therby halt the flow of coins past said wheel after the passage of any number of coins.

2. A count mechanism in accordance with claim 1 wherein said latch is biased to a position engaging a point of said wheel and is held out of engagement with said wheel by energization of a solenoid whose actuator is connected to said latch.

3. A count mechanism in accordance with claim 2 wherein a second solenoid is connected to actuate a lever arm to assist the actuator of the first solenoid to disengage the latch from the wheel.

4. A count mechanism in accordance with claim 1 wherein said wheel has spaced reflective areas on a surface thereof, together with optical sensor means disposed adjacent said surface and responsive to the passage of said reflective areas to produce electrical pulses indicative of the count of coins passing said wheel, and control means responsive to said sensor means for controlling the engagement of said latch.

5. A count mechanism in accordance with claim 4 wherein said sensor means comprises a pair of sensors each including a source of light directed at said surface and a light sensitive receiver responsive to light reflected from said reflective areas, and wherein the sensors are so positioned relative to the space between reflective areas that the electrical pulses of the two sensors are out of phase with each other.

6. A count mechanism in accordance with claim 5 wherein the reflective areas are equally circumferentially spaced over the surface of said wheel and the space between the focus points of the two light sources is other than a whole multiple of the space between the center of adjacent reflective areas.

7. A count mechanism in accordance with claim 6 wherein a logic low pulse is generated by a sensor at a first voltage logic level when reflected light is present at a receiver and wherein said reflective areas are so arranged with respect to said sensors that both sensors show logic low when said wheel is at rest, together with means for testing the output of said receivers at a second, lower voltage logic level when said wheel is at rest so that a logic high signal is given at the lower voltage logic level if the output from said receiver is substantially above the absolute logic low of said first voltage logic level.

8. A count mechanism for a coin dispenser which moves coins single file along a track, said mechanism comprising:

a rotatable wheel having a plurality of equally spaced points about its periphery which lie in the path of travel of coins on said track and which is indexed one point by the passage of each coin;

a detent biased against the periphery of the wheel and tending to settle between successive points to retard rotation of the wheel;

a latch engagable with anyone of the points of said wheel to prevent rotation of said wheel and thereby halt the flow of coins; and count control means including sensor means responsive to the indexing of said wheel to engage said latch when a preselected count of coins of a multiple of one has passed said wheel.

9. A count mechanism in accordance with claim 8 wherein said latch is biased to a position engaging a point on said wheel, and said control means includes a first solenoid connected to said latch to hold the latch out of engagement with said wheel and a second solenoid connected to assist the first solenoid in disengaging said latch from said wheel.

10. A count mechanism for a coin dispenser which moves coins single file along a track, said mechanism comprising:

a rotatable wheel having a plurality of equally spaced points about its periphery which lie in the path of travel of coins on said track and which is indexed one point by the passage of each coin;

said wheel having a plurality of equally spaced reflective areas on a surface equal in number to said points;

optical sensor means disposed adjacent said surface and responsive to the passage of reflective area to produce a signal indicative of the passage of each coin past said wheel;

and a latch controlled by the accumulation of counts from said sensor and and engagable with anyone of the points on said wheel to prevent rotation of said wheel by coins after the passage of any number of coins.

11. A count mechanism in accordance with claim 10 wherein said wheel is provided with a plurality of openings and said reflective areas are formed on the spokes of the wheel between said openings.

12. A count mechanism in accordance with claim 11 wherein said sensor means comprises a pair of sensors each including a source of light directed at said surface and a light sensitive receiver responsive to light reflected from said reflective areas, and wherein the sensors are so positioned relative to the distance between reflective areas that the signals from the sensors are out of phase.

13. A count mechanism in accordance with claim 12 wherein a logic low pulse is generated by a sensor at a first voltage logic level when reflected light is present at a receiver and wherein said reflective areas as so arranged with respect to said sensors that both sensors show logic low when said wheel is at rest, together with means for testing the output of said receivers at a second, lower voltage logic level when said wheel is at rest so that a logic high signal is given at the lower voltage logic level if the output from said receiver is substantially above the absolute logic low of said first voltage logic level.

14. A method of testing the operability of an optical sensor which responds to the passage of spaced reflective areas to produce a logic low signal for a counter having one logic level when a reflective area is adjacent the sensor and a logic high when a reflective area is not adjacent the sensor, comprising:

providing a second logic level whose logic high is in the range of the upper limit of the logic low signal of said sensor;

comparing the signals at the two logic levels; and producing a signal when the sensor signal is a logic high in the second logic level.

* * * * *